United States Patent [19]

Paris

[11] Patent Number: 4,575,956

[45] Date of Patent: Mar. 18, 1986

[54] FOOT RETENTION DEVICE FOR SKI BOOT

[76] Inventor: Jean Paris, Chemin de la Côte, Sevrier, F - 74410 Saint-Jorioz, France

[21] Appl. No.: 645,183

[22] Filed: Aug. 29, 1984

[51] Int. Cl.[4] ..... A43B 5/04

[52] U.S. Cl. ..... 36/119; 36/88

[58] Field of Search ..... 36/117–121, 36/93, 88

[56] References Cited

U.S. PATENT DOCUMENTS

| | | | |
|---|---|---|---|
| 4,192,087 | 3/1980 | Salomon | 36/119 |
| 4,205,467 | 6/1980 | Salomon | 36/119 |
| 4,449,274 | 5/1984 | Balbinot | 36/117 X |

FOREIGN PATENT DOCUMENTS

| | | | |
|---|---|---|---|
| 0073989 | 3/1983 | European Pat. Off. | 36/119 |
| 3236259 | 4/1983 | Fed. Rep. of Germany | 36/119 |

*Primary Examiner*—James Kee Chi

*Attorney, Agent, or Firm*—Pollock, Vande Sande & Priddy

[57] ABSTRACT

The device for retention of the foot in a ski boot (1) having a rigid shell comprises a screw-nut system (12, 11) actuatable (13) by the user, to draw into displacement, according to the contour of the upper side of the foot, the upper end (7) of a strap (5) connected at its other end to the shell (1). The end (7) of the strap (5) is drawn by a small rod (9) in the general form of an approximately rectangular ring connecting the end (7) of the strap (5) to the nut (11). In the unlocked state of the ensemble constituted by control element (13), screw (12) and nut (11), the strap (5) cannot collapse toward the interior of the shell (1), hence cannot create any hindrance to the introduction of the slipper into the boot.

5 Claims, 7 Drawing Figures

FOOT RETENTION DEVICE FOR SKI BOOT

FIELD OF THE INVENTION

The invention relates to boots having rigid shells, particularly for the practise of skiing, in which a soft slipper can be interposed between the shell and the foot, and a retaining device for the forward portion of the foot tends to cause the foot and the shell to act as a unit for the practice of skiing under good conditions. It concerns more particularly an improvement to certain foot tightening devices.

BACKGROUND OF THE INVENTION

Certain tightening devices aim to cause the forward portion of the foot to act as much as possible as a unit with the shell, particularly in the transverse direction, while at the same time avoiding excessive local contact pressures which interfere with the blood circulation and are the cause of sensations of cold, smarting or other pains, comprising a strap whose lower end is solid with the lower part of the shell and whose upper end is solid with a screw-nut device adjustable and controllable by the user. This strap surrounds the upper part of the forward portion of the foot in the metatarsal region, while being generally supported, with or without the interposition of a force distribution plate, on a soft slipper covering the foot. As to the desired technical effect, these devices generally give satisfaction, obviously to different extents depending on the case.

It has however been confirmed that often the known devices do not really assure comfortable retention and good envelopment of the foot. Finally, if the user is led to withdraw the slipper from the shell for any reason whatever, such as repair, drying, etc., the interior portion of the device very often tends to collapse downwardly and thus to restrict the space which remains free, which interferes with its replacement.

SUMMARY OF THE INVENTION

It is these drawbacks which the present invention seeks to overcome, by proposing a device comprising a system with a small rod assuring the displacement of the movable end of the strap which passes along the contour defined by the upper surface of the slipper, the foot being lodged therein. Due to this small rod system, the strap is wound on the upper side of the foot and effects an optimum envelopment of the upper periphery of the foot, the effects of which are translated by a uniform distribution of the pressure forces. According to a supplemental feature, the small rod system or device according to the invention permanently draws upwardly the movable upper end of the strap, in such manner that the slipper can be introduced into the shell without hindrance.

BRIEF DESCRIPTION OF THE DRAWINGS

The technical features of the invention are explained in the description which follows, and for the understanding of which reference will be made to the drawings, wherein:

FIGS. 1 and 2 show a rigid shell ski boot 1 solid with a sole 2. In known manner, the shell 1 can enclose an inner slipper 3 on which is located a support element or force distribution plate 4. An adjustable tightening device acting on the distribution plate 4 is composed of a screw-nut system and of a soft, unextendable strap 5. The strap 5 is attached by its lower end 6 to a point at the base of the shell 1, as shown, or at an inner sole 21 on the lateral edge. Its upper end 7 is connected to the side 8 of a small rod 9 in the form of a ring of generally rectangular shape. This small rod (FIGS. 3 to 5) is open on the side opposite side 8 where it presents two convergent lugs 10 which, at rest, are bent toward the exterior of the ring and obliquely with respect to the general plane of this ring (FIGS. 4 and 5). The lugs 10, resiliently righted so as to be coaxial, take their place in recessed housings arranged on each side in a nut 11, as shown in FIG. 3. This produces an articulation of the small rod 9 with respect to the nut 11; however, lugs 10 in righted position give to the nut the function of a spring weakly drawn upwardly, according to the curvature of the lugs. The nut 11 is subject to translation displacement along a screw 12 located transversely to the longitudinal axis of the boot in the upper portion of the space of the base of shell 1. In known manner, the screw 12, fixed in translation, can be actuated in rotation from the exterior by a control element 13. This element 13 can take the form of a lever articulated about an axis radial with respect to the screw 12 and, acting as a cam in cooperation with a corresponding surface of the shell 1, permit rapid tightening and locking in position, as is known per se. Except for the small rod 9 and its connection to the nut 11, the entire device is part of the state of the art and thus does not require further description.

Figure 1:
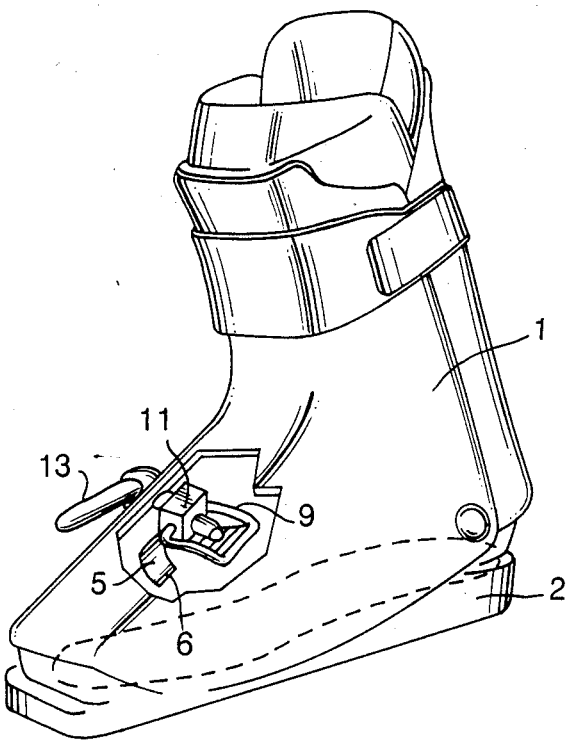
FIG. 1 shows in perspective a boot to which the invention is applied, the shell being partly cut away.
Figure 5:
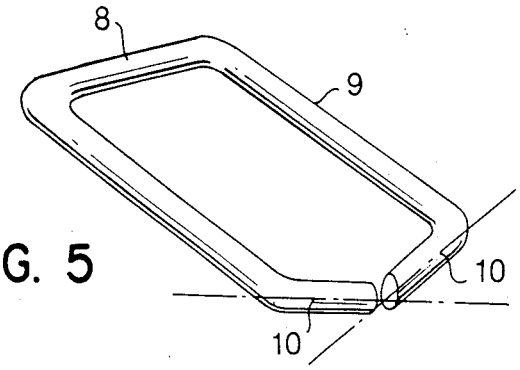
FIGS. 3, 4 and 5 show, respectively in perspective, end and plan views, structural details of the device according to the invention.
Figure 4:
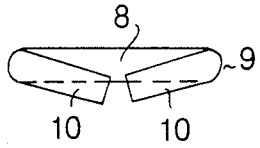
Figure 3:
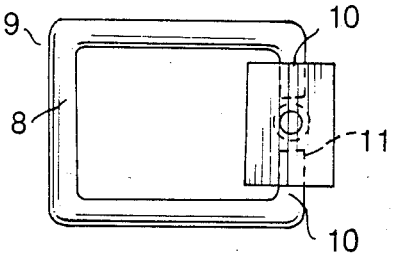
Figure 2:
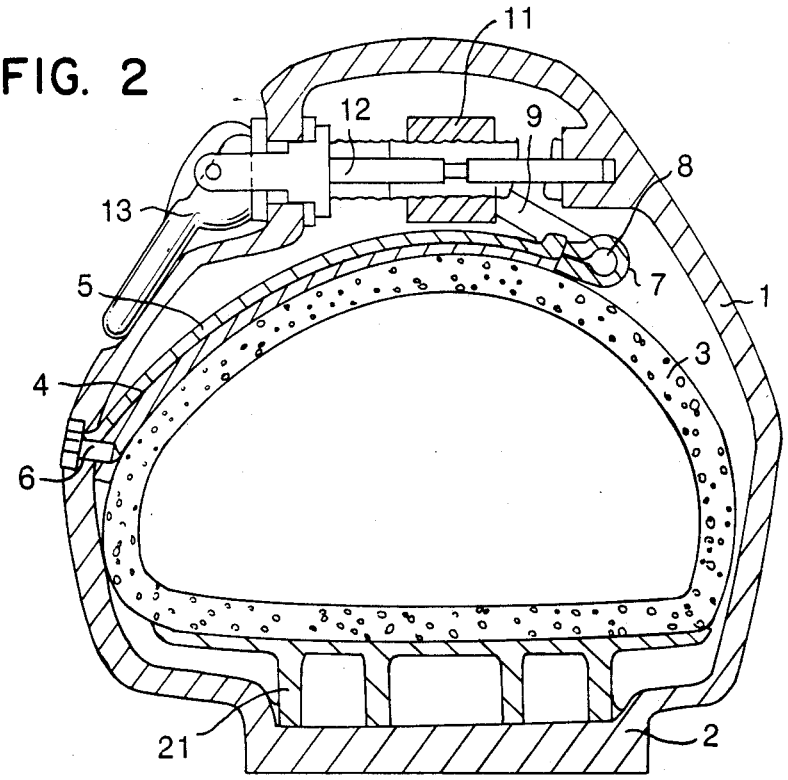
FIG. 2 is a transverse section view of the same boot.

As has been stated, the tightening control device, constituted by the control element 13, the screw 12 and the nut 11, being in unlocked position with the slipper out of the boot, the strap 5 would have a tendency to collapse if it were not maintained in high position by the small rod 9, leaving the interior space of the boot 1 without hindrance which could impede the entry of the slipper 3 during the replacement of the latter.

Figure 7:
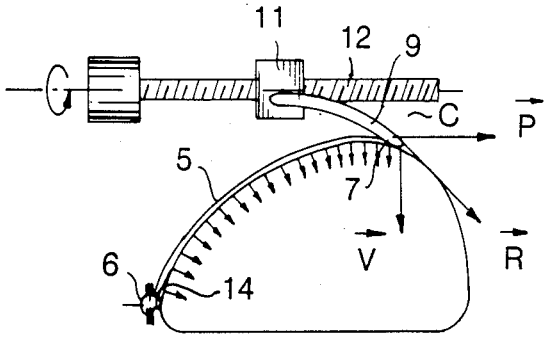
FIG. 7 illustrates the operation of the device according to the invention of which the small rod follows the upper side of the slipper.
Figure 6:
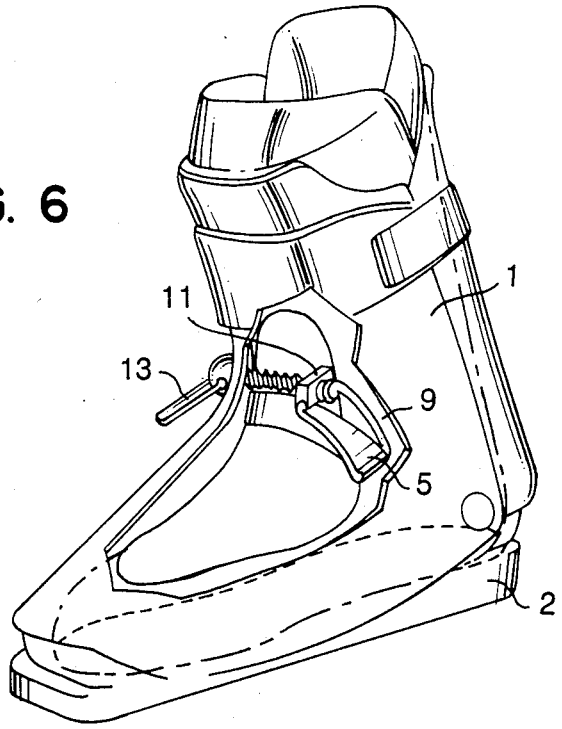
FIG. 6 shows in perspective a boot to which is applied the device according to the invention in order to assure retention of the foot at the level of the neck of the foot.

According to the invention, the small rod 9, to which is transmitted the translational movement of the nut 11 along the screw 12, entrains the end 7 of the strapo 5 which passes along the upper surface 14 of the slipper, eventually provided with the distribution plate 4. This displacement of the end 7 of the strap 5, following the contour 14 of the upper part of the slipper, results from the fact that the small rod is subjected simultaneously to the horizontal thrust P exerted during the displacement of the nut 11 and the vertical restraint V exerted by the strap on the slipper, the resultant R being tangential to the point of contact C of the end of the strap with the contour 14. Because the small rod 9 is articulated on the nut, it can thus follow the contour variations of the said slipper. A complete envelopment of the slipper by the strap between its ends 6 and 7 is therefore obtained, assuring a uniform distribution of the foot retention force (FIG. 7). Obviously, this application of the foot retention device is not limited to that of the forward portion of the foot, but it is possible to adapt it to the retention of the neck of the foot, as is shown in FIG. 6, however little the shell is provided with structural fittings allowing the device to be housed in its walls.

It is clear that other forms of the small adjusting rod for the end 7 of the strap 5 can be used, but the one described is particularly advantageous because it permits the transmission of the tightening force without recourse to a supplemental element. Preferably, also, the small rod 9, to the extent that the lugs 10 are not concerned, will not be absolutely planar, but slightly curved in the direction of the distribution plate 4, i.e., with a concavity turned toward the interior of the boot, as illustrated in FIG. 1.

I claim:

1. Device for tightening a foot in a boot (1) having a rigid shell and containing an inner slipper (3), particularly for the practice of skiing, comprising (a) a screw-nut system (12, 11) actuatable by a user;

(b) a strap (5) arranged transversely of said boot (1) and having a lower end (6) attached to a lower interior portion of said boot;

(c) a small, substantially rectangular transmission rod (9) articulated at one (10) of its sides to a nut (11) of said screw-nut system, and connected at a side (8) opposite said one side to an upper end (7) of said strap (5);

(d) whereby displacement of said nut (11) transversely of said boot (1) is transmitted via said rod (9) to said upper end (7) of said strap (5), causing the same to move along an upper contour (14) of said slipper (3) corresponding to a selected region for tightening said foot.

2. Device according to claim 1, wherein said region is a forward portion of said foot.

3. Device according to claim 1, wherein said region is in the region of the neck of said foot.

4. Device according to claim 1, wherein said one side (10) of said rod (9) is open so as to form two converging lugs which, resiliently aligned in order to be coaxial, fit into recesses on opposite sides of said nut (11).

5. Device according to any one of claim 1 to 4, wherein said rod (9) has, between said lugs (10) and said opposite side (8) a curvature whose concavity is turned toward the interior of said boot.

* * * * *